US011322294B2

(12) United States Patent
Someya et al.

(10) Patent No.: US 11,322,294 B2
(45) Date of Patent: May 3, 2022

(54) COIL COMPONENT

(71) Applicant: TDK CORPORATION, Tokyo (JP)

(72) Inventors: Shuhei Someya, Tokyo (JP); Tasuku Mikogami, Tokyo (JP); Yuichi Anzai, Tokyo (JP); Hideomi Takahashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 560 days.

(21) Appl. No.: 16/394,209

(22) Filed: Apr. 25, 2019

(65) Prior Publication Data

US 2019/0333685 A1 Oct. 31, 2019

(30) Foreign Application Priority Data

Apr. 25, 2018 (JP) ..... JP2018-084254

(51) Int. Cl.

| | |
|---|---|
| ***H01F 27/28*** | (2006.01) |
| ***H01F 17/04*** | (2006.01) |
| ***H01F 27/29*** | (2006.01) |
| *H01F 17/00* | (2006.01) |

(52) U.S. Cl.

CPC ..... *H01F 27/2828* (2013.01); *H01F 17/045* (2013.01); *H01F 27/2804* (2013.01); *H01F 27/292* (2013.01); *H01F 2017/0093* (2013.01); *H01F 2017/046* (2013.01)

(58) Field of Classification Search

CPC .. H01F 27/2828; H01F 17/045; H01F 27/292; H01F 2017/0093; H01F 2017/046

See application file for complete search history.

(56) References Cited

U.S. PATENT DOCUMENTS

| | | | | |
|---|---|---|---|---|
| 2,511,662 A * | 6/1950 | Bachman | H01F 21/06 | 455/289 |
| 5,430,424 A * | 7/1995 | Sato | H01F 27/2804 | 336/200 |
| 6,114,932 A * | 9/2000 | Wester | H01F 17/0006 | 336/192 |
| 6,201,463 B1 * | 3/2001 | Yamashita | H01F 27/324 | 336/198 |
| 6,587,023 B2 * | 7/2003 | Miyazaki | H01F 27/306 | 336/198 |
| 2004/0108932 A1 * | 6/2004 | Satou | H05B 6/662 | 336/182 |

(Continued)

FOREIGN PATENT DOCUMENTS

| | | |
|---|---|---|
| JP | 2008-10578 A | 1/2006 |
| WO | 2015005129 A1 | 1/2015 |

*Primary Examiner* — Mang Tin Bik Lian
*Assistant Examiner* — Malcolm Barnes
(74) *Attorney, Agent, or Firm* — Young Law Firm, P.C.

(57) ABSTRACT

Disclosed herein is a coil component that includes: a first core having a mounting surface and a coil placing surface positioned opposite to the mounting surface; a lower coil placed on the coil placing surface such that a coil axis of the lower coil extends substantially perpendicular to the coil placing surface, the lower coil having one end drawn to a first area of the mounting surface and other end drawn to a second area of the mounting surface; and an upper coil substantially coaxially stacked on the lower coil, the upper coil having one end drawn to a third area of the mounting surface and other end drawn to a fourth area of the mounting surface. The lower coil is greater in a coil diameter than the upper coil.

8 Claims, 5 Drawing Sheets

(56) References Cited

U.S. PATENT DOCUMENTS

| | | | | |
|---|---|---|---|---|
| 2005/0174205 | A1 | 8/2005 | Kitagawa | |
| 2009/0260608 | A1* | 10/2009 | Fujiyama | H01F 38/12 123/634 |
| 2015/0302969 | A1* | 10/2015 | Aaron | G06F 30/36 336/208 |
| 2016/0086725 | A1* | 3/2016 | Igarashi | H01F 17/045 336/83 |
| 2016/0293317 | A1* | 10/2016 | Iwakura | H01F 27/2823 |
| 2016/0307699 | A1 | 10/2016 | Aaron et al. | |
| 2019/0295758 | A1* | 9/2019 | Arihara | H01F 27/28 |
| 2020/0378800 | A1* | 12/2020 | Yun | H01F 7/16 |

* cited by examiner

COIL COMPONENT

BACKGROUND OF THE INVENTION

Field of the Invention

The present invention relates to a coil component and, more particularly, to a coil component having a structure in which a lower coil and an upper coil are stacked one on the other and disposed on a core having a mounting surface.

Description of Related Art

While a common mode filter is used generally for removing common mode noise superimposed on a differential signal line, it is sometimes inserted into a power supply line. In a common mode filter for power supply, a large amount of current flows in a coil, so that a coil formed by winding a wire having a large sectional area, such as a flat-type wire is used in the power supply common mode filter. For example, International Publication WO 2015/005129 discloses a power supply common mode filter having a structure in which two coils each obtained by winding a flat-type wire are stacked one on the other and disposed on a core.

However, the coil component described in International Publication WO 2015/005129 has a structure in which two coils are stacked one on the other and disposed on a core having a mounting surface, so that the coil line length of the upper coil more distanced from the core is greater than the coil line length of the lower coil closer to the core. As a result, the DC resistance of the upper coil is higher than that of the lower coil, which may result in loss of characteristic balance between the lines.

SUMMARY

It is therefore an object of the present invention to reduce a difference in DC resistance between the lower coil and the upper coil in a coil component having a structure in which the lower coil and the upper coil are stacked one on the other and disposed on a core having a mounting surface.

A coil component according to the present invention includes a first core having a mounting surface and a coil placing surface positioned opposite to the mounting surface; a lower coil placed on the coil placing surface such that a coil axis of the lower coil extends substantially perpendicular to the coil placing surface, the lower coil having one end drawn to a first area of the mounting surface and other end drawn to a second area of the mounting surface; and an upper coil substantially coaxially stacked on the lower coil, the upper coil having one end drawn to a third area of the mounting surface and other end drawn to a fourth area of the mounting surface, wherein the lower coil is greater in a coil diameter than the upper coil.

According to the present invention, the coil diameter of the lower coil is larger than the coil diameter of the upper coil, whereby the line length per turn is larger in the lower coil than in the upper coil. This reduces a difference between the line lengths of the lower and upper coils and ideally makes the line lengths of the lower and upper coils coincide with each other, thus making it possible to reduce a difference in DC resistance between the lower and upper coils.

In the present invention, the first and second areas may be arranged in a first direction perpendicular to the coil axis, the third and fourth areas may be arranged in the first direction, the first and third areas may be arranged in a second direction perpendicular to the coil axis and first direction, and the second and fourth areas may be arranged in the second direction. A winding direction from one end of the lower coil to the other end thereof as viewed in the coil axis direction and a winding direction from one end of the upper coil to the other end thereof as viewed in the coil axis direction may be the same as each other. The number of turns of the lower coil may be larger by less than one turn than the number of turns of the upper coil. With this configuration, the coil component can be suitably used as a common mode filter. Further, since the number of turns of the lower coil is larger by less than one turn than the number of turns of the upper coil, a difference between the line lengths of the lower and upper coils can be further reduced.

The coil component according to the present invention may further include a second core disposed through the inner diameter areas of the lower and upper coils, and the diameter of the second core may be larger at a part thereof positioned in the inner diameter part of the upper coil than at a part thereof positioned in the inner diameter part of the lower coil. This enhances the inductance in the upper coil having a smaller number of turns, making it possible to reduce a difference in inductance between the lower and upper coils.

In the present invention, the lower coil may have a detour pattern having a folding structure. This can further reduce the difference between the line lengths of the lower and upper coils.

As described above, according to the present invention, in the coil component having a structure in which the lower and upper coils are stacked one on the other and disposed on the core having the mounting surface, a difference in DC resistance between the lower and upper coils can be reduced.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
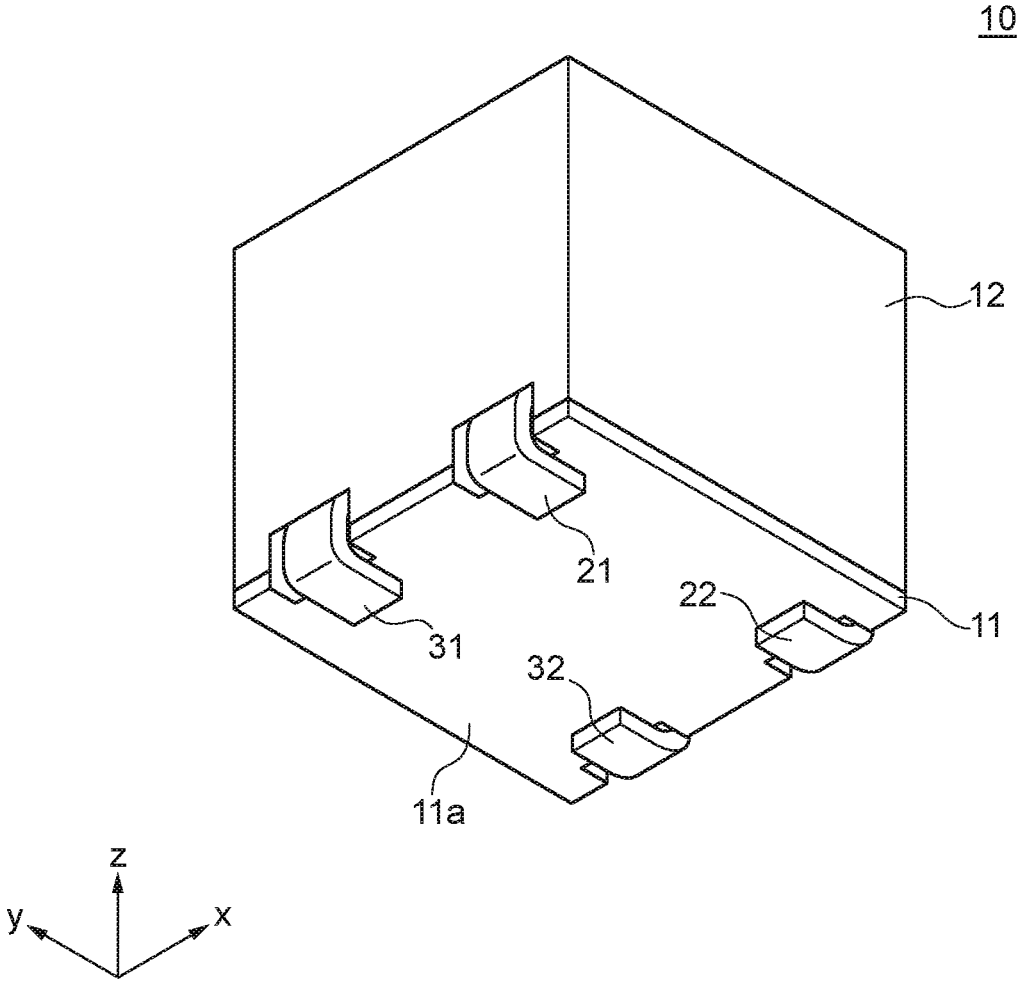
FIG. 1 is a schematic perspective view illustrating the outer structure of a coil component according to a preferred embodiment of the present invention.
Figure 2:
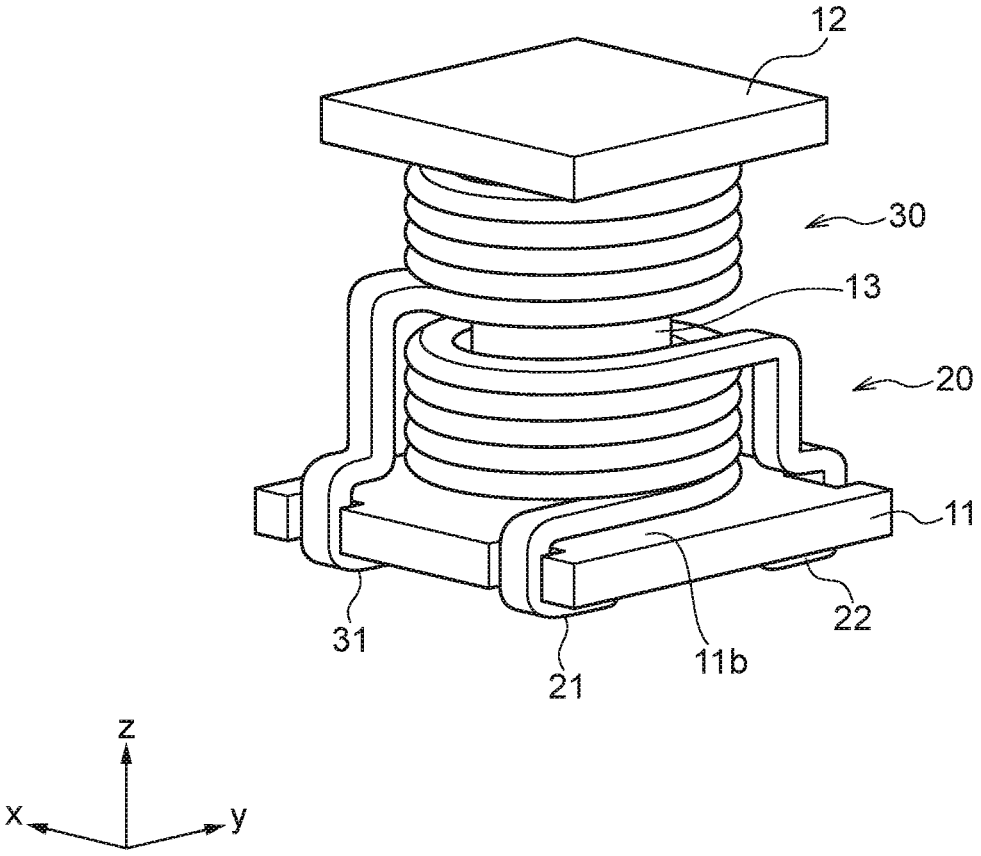
FIG. 2 is a view for explaining the inner structure of the coil component according to the preferred embodiment of the present invention.

FIG. 1 is a schematic perspective view illustrating the outer structure of a coil component 10 according to a preferred embodiment of the present invention. FIG. 2 is a view for explaining the inner structure of the coil component 10 according to the present embodiment.

As illustrated in FIGS. 1 and 2, the coil component 10 according to the present embodiment includes a plate-like core 11 having a mounting surface 11*a*, a lower coil 20 and an upper coil 30 which are disposed on a coil placing surface 11*b* of the core 11, a box-like core 12 covering the lower and upper coils 20 and 30, and a rod-like core 13 disposed through the inner diameter parts of the respective lower and upper coils 20 and 30. In FIG. 2, all the side surfaces (xz- and yz-planes) of the box-like core 12 are omitted so as to make the lower and upper coils 20 and 30 visible. Although all the side surfaces (xz- and yz-planes) are constituted by the core 12 in the example of FIG. 1, some or all of the side surfaces may be constituted by the core 11. The rod-like core 13 may be a member separately formed from the cores 11 and 12 or a member integrally formed with one of the cores 11 and 12.

The mounting surface 11*a* constitutes the xy-plane, and end parts 21, 22 of the lower coil 20 and end parts 31, 32 of the upper coil 30 are disposed at mutually different areas (first to fourth areas) of the mounting surface 11*a*. The mounting surface 11*a* faces a circuit board in amounted state. When the coil component 10 according to the present embodiment is mounted on the circuit board, a land pattern on the circuit board and the end parts 21, 22, 31, and 33 are connected through solders. The end parts 21 and 22 are arranged in the y-direction, the end parts 31 and 32 are arranged in the y-direction, the end parts 21 and 31 are arranged in the x-direction, and the end parts 22 and 32 are arranged in the x-direction. Although, in the present embodiment, the end parts 21 and 31 are provided along the same side extending in the x-direction, and the end parts 22 and 32 are provided along the same side extending in the x-direction, the present invention is not limited to this. For example, the end parts 21 and 22 may be provided along the same side extending in the y-direction, and the end parts 31 and 32 are provided along the same side extending in the y-direction.

As illustrated in FIG. 2, the coil axes of both the lower and upper coils 20 and 30 extend in the z-direction, and the lower and upper coils 20 and 30 are coaxially stacked one on the other in this order and disposed on the coil placing surface 11*b*. In the present embodiment, the lower and upper coils 20 and 30 are constituted by flat-type wires, and the end portions thereof are bent so as to dispose the four end parts 21, 22, 31, and 32 at mutually different areas of the mounting surface 11*a*.

Figure 3A:
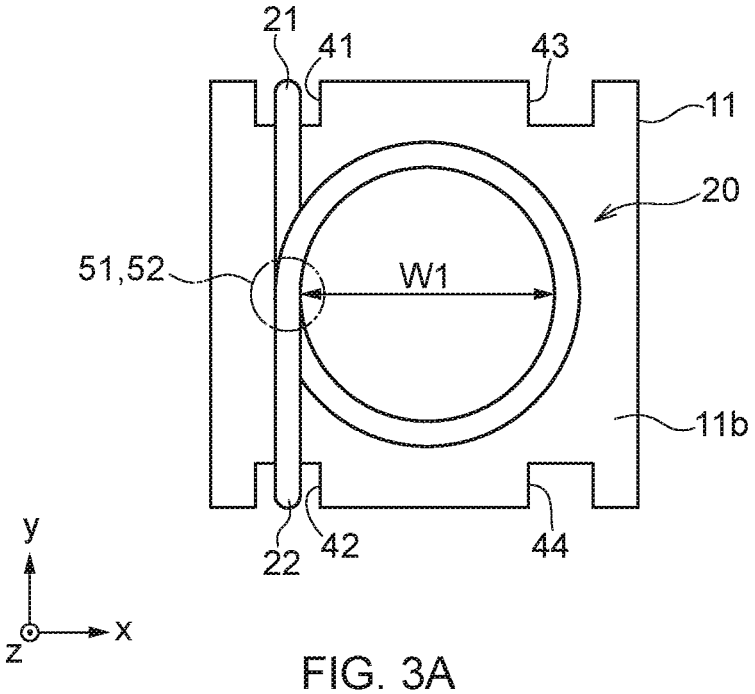
FIG. 3A is a plan view of a lower coil.
Figure 3B:
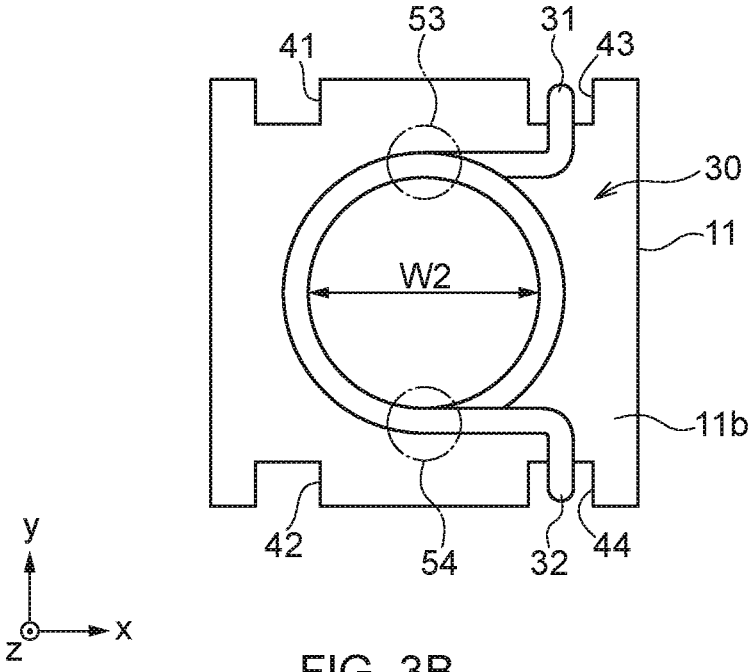
FIG. 3B is a plan view of an upper coil.

FIG. 3A is a plan view of the lower coil 20, and FIG. 3B is a plan view of the upper coil 30.

As illustrated in FIG. 3A, the end parts 21 and 22 of the lower coil 20 are bent to the mounting surface 11*a* side through cuts 41 and 42 formed in the core 11, and the winding direction from the end part 21 toward the end part 22 is counterclockwise (left-handed) as viewed in the z-direction. Similarly, as illustrated in FIG. 3B, the end parts 31 and 32 of the upper coil 30 are bent to the mounting surface 11*a* side through cuts 43 and 44 formed in the core 11, and the winding direction from the end part 31 toward the end part is counterclockwise (left-handed) as viewed in the z-direction. Therefore, when the coil component 10 is used, e.g., as a common mode filter that uses the end parts 21 and 31 as a pair of input side terminals and the end parts 22 and 32 as a pair of output side terminals, the polarities of the input and output side differential signal lines are not reversed.

In the present embodiment, a coil diameter W1 of the lower coil 20 is designed larger than a coil diameter W2 of the upper coil 30, whereby the line length per turn is greater in the lower coil 20 than in the upper coil 30. This is made considering that when the coil diameters of the lower and upper coils 20 and 30 are designed equal to each other, the line length of the upper coil 30 becomes greater by as much as the upper coil 30 is more distant from the mounting surface 11*a*. That is, by designing the coil diameter W1 of the lower coil 20 larger than the coil diameter W2 of the upper coil 30, a difference between the line lengths of the lower and upper coils 20 and 30 is reduced.

As described above, the coil component 10 according to the present embodiment is configured such that the coil diameter W1 of the lower coil 20 closer to the mounting surface 11*a* is made larger than the coil diameter W2 of the upper coil 30 more distanced from the mounting surface 11*a*. Thus, it is possible to reduce a difference between the line lengths of the lower and upper coils 20 and 30 due to a difference in the distance from the mounting surface 11*a*. This reduces a difference in DC resistance between the lower and upper coils 20 and 30, allowing characteristic balance between the lines to be maintained.

Further, as illustrated in FIG. 3A, in the lower coil 20, a winding start position 51 and a winding end position 52 of the wire extending from the end part 21 side almost coincide in position with each other; on the other hand, as illustrated in FIG. 3B, in the upper coil 30, a winding start position 53 and a winding end position 54 of the wire extending from the end part 31 side are shifted in position from each other by 0.5 turns. This means that it is difficult to make the number of turns of the lower coil 20 and that of the upper coil 30 completely coincide with each other, and a difference of less than one turn occurs between the lower and upper coils 20 and 30. By exploiting the above characteristics, that is, by assigning the configuration in which the number of turns is increased by less than one turn to the lower coil 20, it is possible to reduce a difference between the line lengths of the lower and upper coils 20 and 30. When a difference between the line lengths of the lower and upper coils 20 and 30 can be reduced sufficiently by this method, a difference between the coil diameter W1 of the lower coil 20 and the coil diameter W2 of the upper coil 30 may not necessarily be provided.

Figure 4:
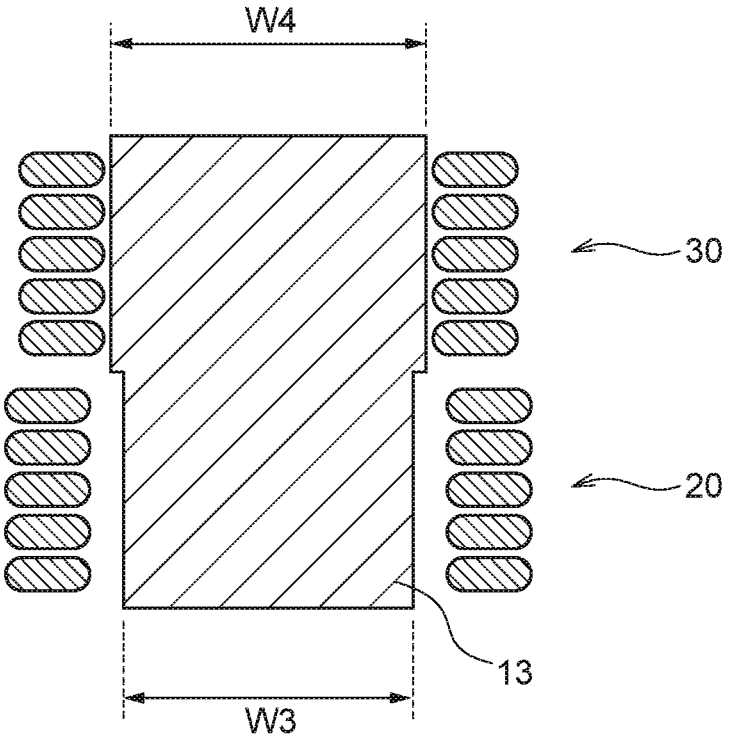
FIG. 4 is a partial cross-sectional view of the coil component according to the preferred embodiment of the present invention.

When the configuration in which the number of turns is increased by less than one turn is assigned to the lower coil 20, a difference in inductance occurs between the lower and upper coils 20 and 30 due to the slight difference in the number of turns. In order to reduce the difference in inductance, the configuration illustrated in FIG. 4 which is a cross-sectional view of the coil component 10 may be adopted. That is, a diameter W4 of a part of the rod-like core 13 that is positioned in the inner diameter part of the upper coil 30 is made larger than a diameter W3 of a part of the rod-like core 13 that is positioned in the inner diameter part of the lower coil 20. With this configuration, inductance per turn is larger in the upper coil 30 than in the lower coil 20, making it possible to reduce the difference in inductance caused due to the difference in the number of turns.

Figure 5:
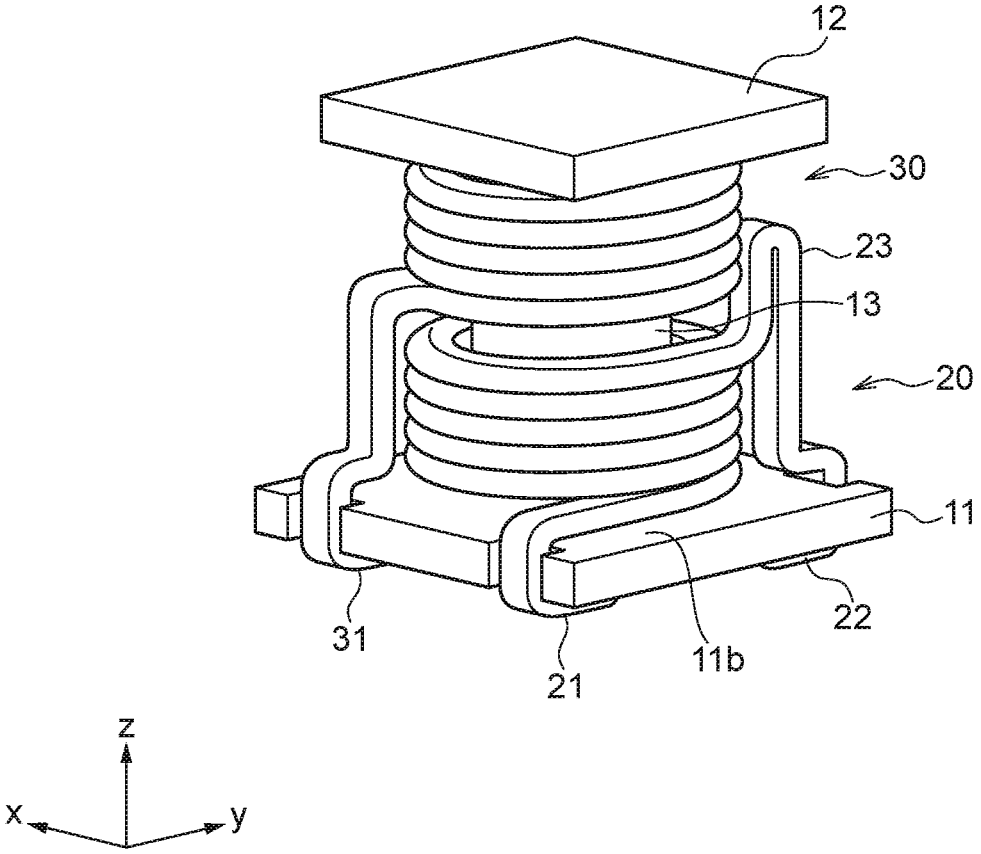
FIG. 5 is a view for explaining the inner structure of a coil component according to a modification.

Further, as illustrated in FIG. 5, which illustrates a modification, it is possible to increase the line length of the lower coil 20 by providing a detour pattern 23 having a folding structure in the lower coil 20. Further, although not illustrated, a difference in DC resistance may be reduced by using a wire smaller in diameter than a wire constituting the upper coil 30 to constitute the lower coil 20.

It is apparent that the present invention is not limited to the above embodiments, but may be modified and changed without departing from the scope and spirit of the invention.

What is claimed is:

1. A coil component comprising:

a first core having a mounting surface and a coil placing surface positioned opposite to the mounting surface;

a lower coil placed on the coil placing surface such that a coil axis of the lower coil extends substantially perpendicular to the coil placing surface, the lower coil having one end drawn to a first area of the mounting surface and other end drawn to a second area of the mounting surface; and an upper coil substantially coaxially stacked on the lower coil, the upper coil having one end drawn to a third area of the mounting surface and other end drawn to a fourth area of the mounting surface, wherein the lower coil is greater in a coil diameter than the upper coil, wherein the first and second areas are arranged in a first direction substantially perpendicular to the coil axis, wherein the third and fourth areas are arranged in the first direction, wherein the first and third areas are arranged in a second direction substantially perpendicular to the coil axis and first direction, wherein the second and fourth areas are arranged in the second direction, wherein a winding direction from the one end of the lower coil to the other end of the lower coil as viewed in a coil axis direction is the same as a winding direction from the one end of the upper coil to the other end of the upper coil as viewed in the coil axis direction, and wherein a number of turns of the lower coil is larger by less than one turn than a number of turns of the upper coil.

2. The coil component as claimed in claim 1, further comprising a second core disposed through inner diameter areas of the lower and upper coils, wherein the second core has a lower section surrounded by the lower coil and an upper section surrounded by the upper coil, and wherein the upper section is greater in a diameter than the lower section.

3. The coil component as claimed in claim 1, wherein the lower coil has a detour pattern having a folding structure.

4. A coil component comprising:

a magnetic core having first and second sections arranged in a first direction;

a first coil wound around the first section of the magnetic core; and a second coil wound around the second section of the magnetic core, wherein diameters of the first and second sections perpendicular to the first direction are different from each other, wherein inner diameters of the first and second coils perpendicular to the first direction are different from each other, wherein the diameter of the first section is smaller than the diameter of the second section, and wherein the inner diameter of the first coil is greater than the inner diameter of the second coil.

5. The coil component as claimed in claim 4, further comprising:

another magnetic core arranged such that the first section of the magnetic core is located between the second section of the magnetic core and the another magnetic core;

a first terminal electrode connected to one end of the first coil;

a second terminal electrode connected to other end of the first coil;

a third terminal electrode connected to one end of the second coil; and a fourth terminal electrode connected to other end of the second coil.

6. The coil component as claimed in claim 5, wherein numbers of turns of the first and second coils are different from each other.

7. The coil component as claimed in claim 6, wherein the number of turns of the first coil is greater than the number of turns of the second coil.

8. A coil component comprising:

a magnetic core having first and second sections arranged in a first direction;

a first coil wound around the first section of the magnetic core; and a second coil wound around the second section of the magnetic core, wherein numbers of turns of the first and second coils are different from each other, and wherein inner diameters of the first and second coils perpendicular to the first direction are different from each other, wherein the number of turns of the first coil is greater than the number of turns of the second coil, and wherein the inner diameter of the first coil is greater than the inner diameter of the second coil.

* * * * *